US005411112A

United States Patent [19]

Jephcott

[11] Patent Number: 5,411,112

[45] Date of Patent: May 2, 1995

[54] APPARATUS FOR ESCALADING

[76] Inventor: David L. Jephcott, The Conifers, Heath Cote Avenue, Ashley Heath, Nr. Market Drayton, Shropshire, United Kingdom, TF9 4QF

[21] Appl. No.: 37,270

[22] Filed: Mar. 26, 1993

[30] Foreign Application Priority Data

Feb. 5, 1993 [GB] United Kingdom ..... 9302283

[51] Int. Cl.[6] ..... E04C 2/00

[52] U.S. Cl. ..... 182/84; 182/36; 182/8

[58] Field of Search ..... 182/84, 36, 37, 38, 182/85, 8

[56] References Cited

U.S. PATENT DOCUMENTS

| | | | |
|---|---|---|---|
| 644,048 | 2/1900 | Andre | 182/38 X |
| 662,108 | 11/1900 | Balfour | 182/38 |
| 1,027,546 | 5/1912 | Johnson | 182/36 X |
| 1,916,208 | 7/1933 | Diou | 182/8 |
| 2,543,348 | 2/1951 | Briese | 182/37 X |
| 3,305,113 | 2/1967 | Gardner | 182/37 X |
| 4,378,860 | 4/1983 | Newberry | 182/38 |
| 4,396,092 | 8/1983 | Thompson | 182/38 |
| 4,646,877 | 3/1987 | Whan | 182/38 |

FOREIGN PATENT DOCUMENTS

| | | | |
|---|---|---|---|
| 1041385 | 10/1953 | France | 182/36 |
| 1217 | of 1892 | United Kingdom | 182/38 |
| 358052 | 10/1931 | United Kingdom . | |
| 373403 | 5/1932 | United Kingdom . | |
| 520400 | 4/1940 | United Kingdom . | |

*Primary Examiner*—Karen J. Chotkowski

*Attorney, Agent, or Firm*—Renner, Otto, Boisselle & Sklar

[57] ABSTRACT

In the field of materials handling, e.g., in warehouses, there is a need for a low-cost shelving access system which does not require a user thereof to carry objects whilst negotiating, e.g., ladders and steps. The disclosure relates to an apparatus including a framework (11); a generally vertical ladder (12*a*, 12*b*) secured to the framework; and a goods hoist (20) secured to the framework in such a way that the platform (22*a*, 22*b*) of the goods hoist (20) may be maneuvered to a plurality of locations adjacent the ladder (12*a*, 12*b*). The ladder (12*a*, 12*b*) is moveable laterally on the framework to enable the platform (22*a*, 22*b*) of the goods hoist to access any position within the envelope defined by the framework (11).

19 Claims, 2 Drawing Sheets

APPARATUS FOR ESCALADING

BACKGROUND OF THE INVENTION

This invention relates to an apparatus for escalading.

The basic design of the ladder has been known for many years. The ladder has proved over many centuries to be one of the most useful inventions ever devised.

However, the ladder does suffer numerous disadvantages. Most notably, these disadvantages are concerned with the safety of users of ladders. There have been innumerable incidents of ladder users falling off ladders and suffering severe injuries, or sometimes even death.

One of the main causes of accidents amongst ladder users is that many ladder users attempt to carry objects such as tools, building materials, decorating equipment, etc. up ladders by hand. Such practices frequently cause ladder users only to have at best one hand and one foot in contact with the ladder. It is therefore easy for the ladder to overbalance, or for the ladder user simply to miss his footing and fall off the ladder.

Legislation has recently been introduced throughout the EC requiring ladder users not to carry any objects when ascending or descending a ladder at a place of work. Clearly, there is a strong need for a new design of apparatus the use of which satisfies the legislative requirements.

SUMMARY OF THE INVENTION

According to a first aspect of the invention, there is provided an apparatus for escalading, comprising an upwardly extending framework; an upwardly extending ladder secured to the framework; and a goods hoist including load supporting means, the hoist being secured to the framework such that the load supporting means may be maneuvered laterally and vertically relative to the framework to a plurality of positions.

An advantage of this apparatus is that the goods hoist may be lifted to a desired level on the apparatus for escalading, and a user of the apparatus may climb unhindered to that level before loading or unloading the goods hoist, in complete safety.

This arrangement has numerous advantages. Firstly, the inclusion of a ladder in the apparatus utilizes conventional technology which is cheap and easy to manufacture.

Secondly, the securing of a ladder and a goods hoist in a framework means that the apparatus can be built as a discrete item, for subsequent attachment (if desired) to a further structure.

Thirdly, the fact that the load supporting means may be manoeuvred to a plurality of positions adjacent the ladder means that the apparatus is versatile and safe to use in a number of configurations.

Fourthly, the load supporting means of the hoist may be similarly moved to a great number of locations.

Preferably the apparatus may include means for securing the framework to a further structure.

This arrangement allows the apparatus to be used, e.g., in conjunction with fixed warehouse shelving.

Preferred embodiments of the invention include means for securing the framework to a ceiling. This feature allows the apparatus to be secured in front of, e.g., unsafe or incomplete structures.

Conveniently, the height and/or the length of the framework are adjustable. These features improve the versatility of the apparatus.

Preferably, the ladder is adapted to move laterally on the framework. This means that a user of the apparatus may access a greater plurality of locations defined by both vertical and horizontal coordinates.

In a particularly preferred embodiment, the hoist and ladder are rigidly interconnected. It has been found to be particularly advantageous for the hoist to be moveable with the ladder on the framework.

The framework may preferably include a guide rail or track and the ladder may include means co-operating with the guide rail or track to permit lateral movement of the ladder on the framework. This arrangement has been found to be the most effective for providing lateral movement of the ladder on the framework.

Additionally or alternatively, the hoist may include means for cooperating with the or a guide rail or track to permit lateral movement of the hoist on the guide rail or track. This feature is particularly advantageous in embodiments wherein the hoist and the ladder are rigidly interconnected. (It is then desirable to ensure that lateral movements of the hoist and the ladder are coordinated one with the other.)

In a particularly preferred embodiment, the hoist may include an upwardly extending member having a channel therein; a load platform constrained to move along the member with a part engaged in the channel; and drive means whereby the platform may be driven along the member.

In an alternative embodiment, the upwardly extending member includes a protection adapted to engage a part of the load platform.

In a particularly preferred embodiment, the apparatus comprises a pair of ladders secured on the framework. This allows the apparatus to be highly versatile.

In one optional form of the invention, the pair of ladders are interconnected by the load supporting platform of a common goods hoist. This version of the invention is particularly suitable for use in warehousing where elongate objects are stored on shelves, since the load supporting means of the goods hoist may be sized adequately to raise and lower such elongate components.

Alternatively, there may be provided a separate goods hoists associated with each ladder.

Conveniently, the apparatus may include a harness secured to the or a ladder, whereby a user of the apparatus may be prevented from falling from the apparatus. Optionally, the goods hoist may be arranged to be inoperative unless the harness is fastened about a user of the apparatus.

These two features advantageously improve the safety of the device in use.

A framework suitable for use in apparatus as aforesaid comprises a plurality of elongate members secured one to another such that, in use of the framework, at least one of the elongate members extends horizontally, said elongate member being adapted for the laterally moveable securing thereon of a ladder and/or a hoist.

A ladder suitable for use in apparatus as aforesaid, is such that at least one of the uprights of the ladder includes a hook extending therefrom so as to permit suspending of the ladder on the framework by means of the hook.

BRIEF DESCRIPTION OF THE DRAWINGS

There now follows a description of a preferred embodiment of the invention, by way of example, with reference being made to the accompanying drawings in which.

Figure 1:
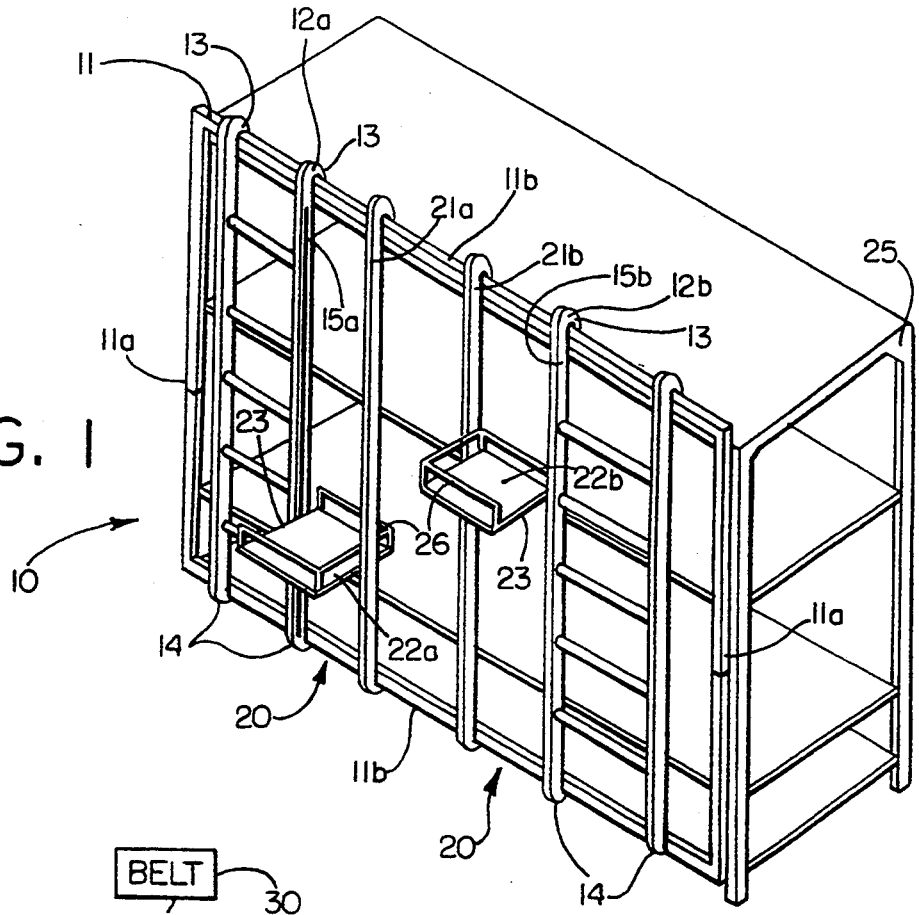
FIG. 1 is a perspective view of one form of apparatus in accordance with the invention.

Referring to the drawings, there is shown an apparatus 10 for escalading, the apparatus including a pair of goods hoists 20.

DETAILED DESCRIPTION

Figure 2:
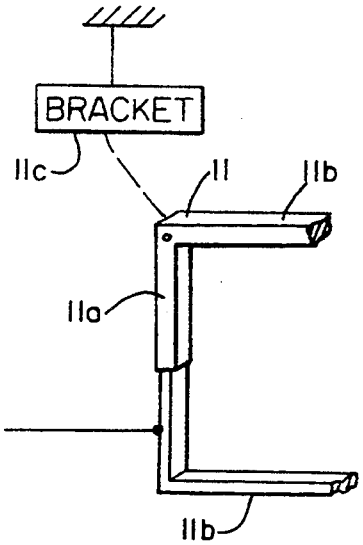
FIG. 2 is a schematic, perspective view of part of the framework shown in FIG. 1.

The apparatus 10 includes a rectangular framework 11. Framework 11 consists of a series of square or rectangular section members secured to one another in a rectangle. As best shown in FIG. 2, the height of the rectangle is adjustable by means of the members 11*a* (which constitute the upright ends of the rectangle) being adjustable in length. This is achieved by virtue of the members 11*a* being constituted by pairs of members, one of which is hollow, of differing cross sectional dimensions. The smaller of the two members 11*a* at each end of the framework 11 is adapted to slide into the larger of the two members in the manner of a telescope. Means may be provided for locking the members 11*a* to give rise to a desired overall height of the framework.

The members 11*b* interconnecting the upright members 11*a* may be adjusted by means of similar mechanisms, whereby the length of the framework 11 may also be adjusted.

In an alternative embodiment (not shown), the feature permitting adjustment of the size of the framework may be dispensed with. Such an embodiment could be manufactured as a bespoke item, according to the requirement of a user thereof.

A pair of ladders 12*a*, 12*b* is secured on the framework 11. The ladders 12*a*, 12*b* are of conventional design, except that the upper ends 13 of the respective ladder uprights are formed into hook-like protections. The protections 13 hook over the top edge of the upper member 11*b*. The undersides of the hook-like projections 13 are shaped to be complementary to the upper surface of upper member 11*b*, whereby the ladders 12*a*, 12*b* are retained captive on the framework 11 when the framework 11 is placed in an upright position as shown.

Suitable bearings (such as roller bearings or needle bearings) are in the embodiments shown secured interposed between the undersides of the hook-like projections 13 and the upper surface of upper member 11*b*. Thus, the ladders 12*a*, 12*b* are readily slidable from side to side along the framework upper member 11*b*. Alternatively or additionally, the bearings may be secured in the upper surface of the member 11*b*.

The lower ends 14 of the ladder uprights are shaped similarly to the upper ends 13, and hook under the lower surface of the lower member 11*b*. Bearings (again such as roller or needle bearings) may be secured interposed between the upper surfaces of the hook-like protections 14 and the lower surface of the lower member 11*b*, whereby the ladders 12*a*, 12*b* are retained captive on the framework 11. It will thus be appreciated that the ladders 12*a*, 12*b* may freely be moved from side to side on the framework 11. The securing of the ladders 12*a*, 12*b* at both the top and bottom ends thereof ensures the ladders are secure and stable on the framework 11.

The ladders 12*a*, 12*b* may be removed from the framework simply by sliding them off one or other end thereof. However, if desired, stops may be added e.g. in the form of upwardly and downwardly projecting extensions of the side members 11*a*, to prevent the ladders from running off the ends of the framework 11. Such stops may be removable.

Further uprights 21*a*, 21*b* are respectively secured in an analogous manner to extend on the framework between the upper and lower members 11*b* parallel to the uprights of the ladders 12*a*, 12*b* and spaced a short distance laterally therefrom.

The further uprights 21*a*, 21*b* include guide channels for respective hoist platforms 22*a*, 22*b*. The uprights 21*a*, 21*b* are in the embodiment shown constrained to move laterally with the respective ladders 12*a*, 12*b* with which they are associated. This is achieved by means of respective rigid interconnection between the respective ladders 12*a*, 12*b* and the associated uprights 21*a*, 21*b*.

Figure 5:
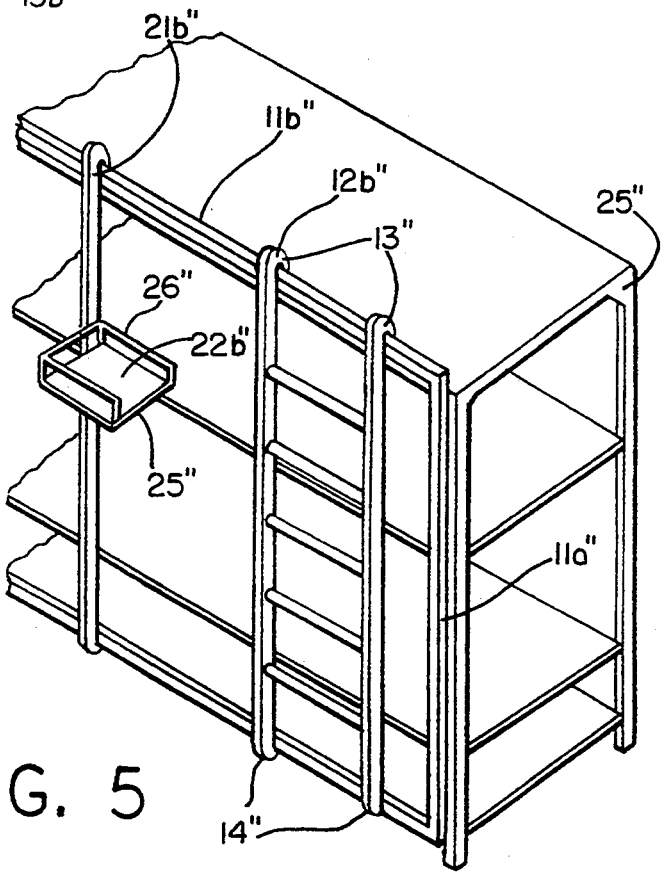
FIG. 5 is a fragmentary perspective view of another modified form of apparatus in accordance with the invention.

In an alternative embodiment, one or more of the rigid interconnections between the ladders 12*a*, 12*b* and the respective uprights 21*a*, 21*b* may be dispensed with. This would allow one or both the uprights 21*a*, 21*b* and hence the hoist platforms 22*a*, 22*b*, to be laterally moveable on the framework 11 independently of the associated ladder 12*a*, 12*b* as depicted in FIG. 5 wherein double primed reference numerals designate elements corresponding generally to those identified above by the same unprimed reference numerals. Thus, one or more of the ladders would be useable in a more conventional manner if desired, without the need to manoeuvre a hoist with the ladder.

Each member 21*a*, 21*b* in the embodiment shown includes a channel into which a projecting portion of the respective hoist platform 22*a*, 22*b* is engaged, for guidance purposes.

Figure 3:
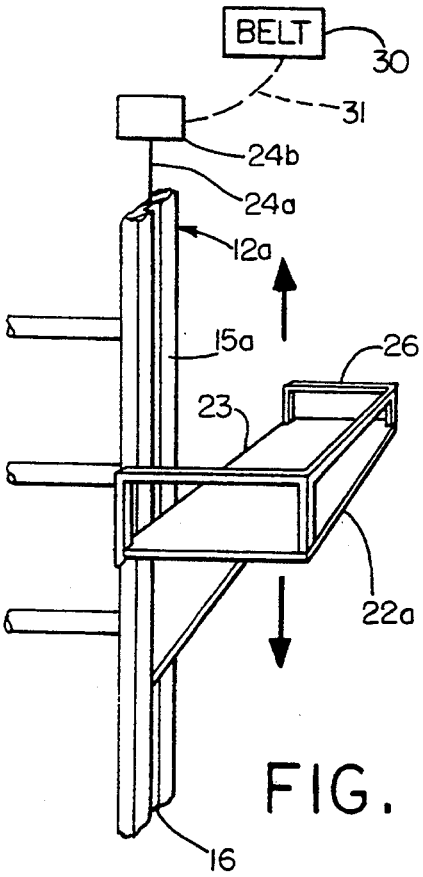
FIG. 3 is an enlarged, perspective view of one of the goods hoists of the apparatus of FIG. 1 and, FIG. 4 is a fragmentary perspective view of a modified form of apparatus in accordance with the invention.

As best shown in FIG. 3, the respective uprights 15*a*, 15*b* of each ladder 12*a*, 12*b* adjacent the corresponding upright 21*a*, 21*b* include a channel 16 extending along the length thereof.

An edge 23 of each respective platform 22*a*, 22*b* is constrained to move adjacent the associated channel 16, by virtue of a protection on the respective platforms 22*a*, 22*b* engaging into the channel 16. Drive means such as chains or belts 24*a* for the hoist platforms 22*a*, 22*b* are disposed within the respective channels 16 in operative engagement with the protections on the respective platforms 22*a*, 22*b*. It will thus be appreciated that actuation of one of the drive means either upwardly or downwardly causes upward or downward movement of the hoist platform 22*a*, 22*b* connected thereto.

A motor means 24*b* may be provided, whereby the drive means may be actuated automatically. A suitable control switch may also be provided for the motor means.

It will thus be seen that the two hoist platforms 22*a*, 22*b* may between them be moved to any position within the rectangular envelope defined by the framework 11. This is achieved by sliding one or other of the ladder plus hoist assemblies as appropriate along the framework as described hereinabove, and selective raising or lowering of the desired platform 22*a*, 22*b* until it rests at a suitable height.

As shown in FIG. 1, the apparatus is secured by means of suitable fixings (such as bolts, rivets, etc.) to a shelving rack 25. This method of fixing is suitable when the apparatus is to be used in conjunction with a firmly secured structure, such as wall-secured shelving. The shelving provides a firm mounting for the apparatus.

However, it may be desired to use the apparatus in conjunction with, e.g., unstable shelving or perhaps an incomplete structure. Under such circumstances, the framework 11 may be equipped with jacking feet (not shown). Additionally, suitable fixing means may be secured to the framework 11 whereby the apparatus may be secured to, e.g., a ceiling or overhead beam; or an adjacent wall. Such means may be in the form of, e.g., angle brackets extending upwardly of the upper member 11*b*, one being illustrated in FIG. 2 at 11*c*.

The apparatus shown may optionally include a pair of harnesses (one depicted at 30 in FIG. 3) secured respectively to ladders 12*a*, 12*b*. The harnesses would be slidable up and down the respective ladders, and would be suitable for wearing by a user of the apparatus. The purpose of the harnesses would be to prevent users from falling off the apparatus.

It is contemplated that the harnesses would include electrical and/or mechanical interlock means, 31 whereby the hoist platforms 22*a*, 22*b* would be rendered immobile unless the harnesses are secured about the users of the apparatus.

In an alternative arrangement, a single harness may be provided, the harness being detachable from one of the ladders 12*a*, 12*b* and reattachable to the other ladder 12*a*, 12*b* as desired.

Figure 4:
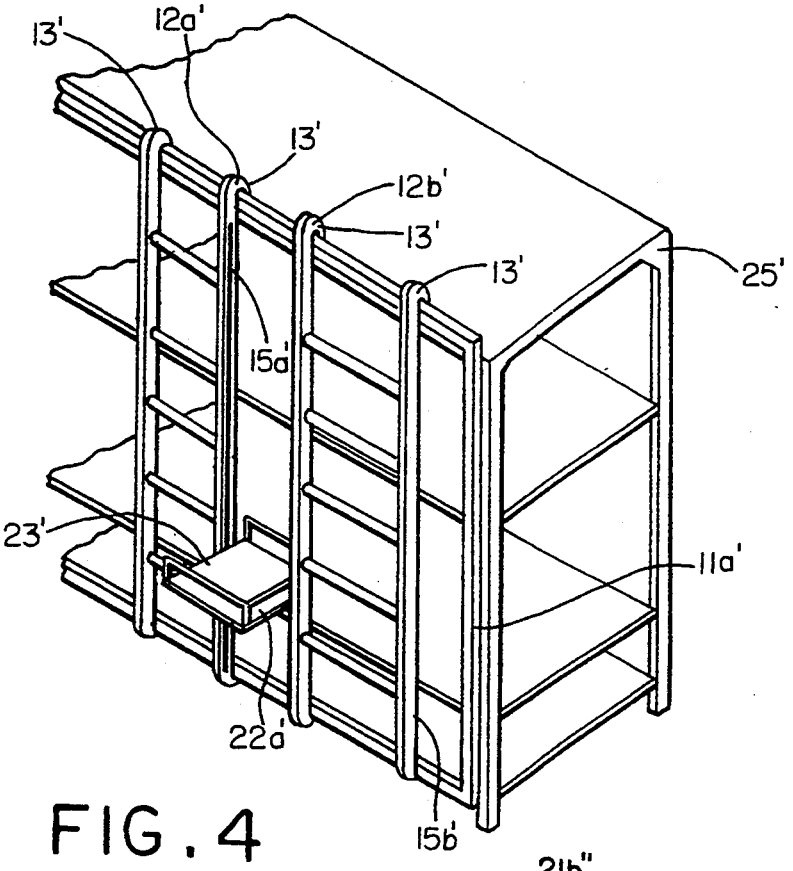

Yet a further variant of the invention comprises a pair of ladders such as 12*a*, 12*b* having upright members 15*a*, 15*b* as shown in FIG. 1. However, the pair of platforms 22*a*, 22*b* and the corresponding guide uprights 21*a*, 21*b* would be dispensed with. Instead, a single hoist platform may be provided interconnecting the uprights 15*a*, 15*b* in a vertically slidable manner as depicted in FIG. 4 wherein primed reference numerals designate elements corresponding generally to those identified above by the same unprimed reference numerals. This arrangement is particularly suitable when the apparatus is intended for carrying elongate objects such as vehicle exhaust pipes. Obviously, in this embodiment the two ladders 12*a*, 12*b* would be simultaneously laterally moveable.

The embodiment shown in FIGS. 1 to 3 includes guarding 26 extending around three of the four sides of each rectangular platform 22*a*, 22*b*. The guarding 26 is open along one edge 23 of each platform for ease of loading of the respective platforms.

In the embodiment shown, the ladder and hoist assemblies are moveable laterally by means of manual propulsion. However, the lateral motion of the assemblies could be motorised if desired. Suitable control means such as switch gear and a power supply could be incorporated.

There may be provided more than the two hoist and ladder assemblies shown in the drawings, especially if the framework 11 is constructed having a long length. For example, many warehouse shelf units are more than 15 meters long. It would be impractical in some cases to attempt to provide rapid acces of a hoist and ladder assemblies to all parts of the frontage of such a shelf unit if only two hoist and ladder assemblies are provided.

In embodiments in which ladders and hoists are laterally moveable independently of one another, a disparate number of ladders and hoists may be provided if desired.

In use of the apparatus, an operator would initially position one of the hoist platforms at an appropriate position for loading or unloading, by sliding one or other of the ladder and hoist assemblies laterally and actuating the drive means for the hoist in question until the platform is at a desired lateral and vertical position. The position of the platform could if necessary be locked by means of an interlock effective on the drive means. The operator would then climb the ladder adjacent the positioned hoist, having first secured himself into the harness if this is a requirement in the installation concerned. Once the operator reaches the height of the platform it is an easy matter for him to load goods from, e.g., a shelf disposed adjacent the platform onto the platform itself.

The operator would then return to floor level or the level of another shelf and operate the hoist to bring the platform to a desired level for unloading. The hoist and ladder assembly could be moved laterally to position the platform as desired.

Clearly, the sequence of operations required to load items from floor level onto shelving would generally be a reverse of the above described procedure.

The apparatus provides a low-cost solution to a common problem in warehouse storage installations. The apparatus is cheaper to fabricate and maintain than, for example, a stacker truck, and moreover may readily be used e.g. in relation to mezzanine level shelving and in conjunction with shelving units spaced apart only by narrow aisles. Such places are generally inaccessible to stacker trucks.

The embodiment described is adjustable in height and length. In such an embodiment, adjustable length ladders 12*a*, 12*b* and upright members 21*a*, 21*b* may be employed. Alternatively, a range of sizes of ladders and upright members may be available, and the framework 11 adjusted to a height to suit the ladders and uprights chosen.

Many variants on the arrangements described herein may be devised in accordance with the invention. For example, the ladders of the preferred embodiment may be replaced by alternative means such as a flight of steps. Optionally the ladders may be replaced by e.g. further hoists adapted to raise and lower users of the apparatus in safety. One form of such a hoist may be a kind of escalator comprising a horizontal rung constrained and driveable to move vertically in a pair of guide channels formed in a corresponding pair of upright members moveably on the framework. A suitable safety harness may be provided in conjunction with the rung to ensure that a user stepping onto the rung does not run the risk of falling off the apparatus during movement of the rung.

A suitable method for the construction of the apparatus is by fabrication (e.g. by welding, riveting and screwing) from e.g., mild steel. However, various other materials could be used. For example, lightweight alloy metals could be used in certain installations. There may also be a requirement to minimise the risk of explosion in certain environments. The apparatus could then be manufactured from or coated with a material which is unlikely to cause sparking. When the apparatus is to be used in areas of high flammability, and in certain other applications, the drive to the hoist platforms is preferably either manual or hydraulic. The use of such drives is not precluded in nonflammable applications.

What is claimed is:

1. An apparatus for escalading comprising an upwardly extending framework adapted to be secured to a further structure; an upwardly extending ladder secured in the framework; and a goods hoist including load supporting means, and means for securing said goods hoist in said framework with said load supporting means being guided for continuous lateral and vertical movement relative to the framework to a plurality of positions.

2. An apparatus according to claim 1 including means for securing the framework to a further structure.

3. An apparatus according to claim 1 including means for securing the framework to a ceiling.

4. An apparatus according to claim 1 including means whereby the height of the framework is adjustable.

5. An apparatus according to claim 1 including means whereby the length of the framework is adjustable.

6. An apparatus according to claim 1 wherein the ladder is adapted to move laterally on the framework.

7. An apparatus according to claim 6 wherein the framework includes a guide rail or track and the ladder includes means co-operating with the guide rail or track to permit lateral movement of the ladder on the framework.

8. An apparatus according to claim 1 wherein the hoist and the ladder are rigidly interconnected.

9. An apparatus according to claim 1 wherein the framework includes a guide rail or track and the hoist includes means cooperating with the guide rail or tract to permit lateral movement of the hoist on the guide rail or track.

10. An apparatus according to claim 1 wherein the hoist includes an upwardly extending member having a channel formed therein; a load platform constrained to move along the member with a part engaged in the channel; and drive means whereby the platform may be driven along the member.

11. An apparatus according to claim 1 comprising a pair of ladders secured on the framework.

12. An apparatus according to claim 11, wherein the ladders are interconnected by a common goods hoist.

13. An apparatus according to claim 11 including a separate goods hoist secured to each ladder.

14. An apparatus according to claim 1 wherein the ladder secured on the framework is moveable independently of any goods hoist secured on the framework.

15. An apparatus according to claim 1 including a harness secured to the ladder, whereby a user of the apparatus may be prevented from falling from the apparatus.

16. An apparatus according to claim 15 including means for rendering the load platform inoperative unless the harness is fastened about a user of the apparatus.

17. A ladder for use in apparatus according to claim 1 wherein at least one of the uprights of the ladder includes a hook extending therefrom so as to permit suspending of the ladder on the framework by means of the hook.

18. A ladder according to claim 17 wherein the hook includes a bearing means disposed to support the hook, and hence the ladder, on the framework.

19. A ladder according to claim 17 including a hoist secured thereto.

* * * * *